United States Patent [19]

Arai

[11] Patent Number: 4,942,813

[45] Date of Patent: Jul. 24, 1990

[54] METHOD AND APPARATUS FOR DRY OFFSET INTAGLIO PRINTING

[75] Inventor: Shigeji Arai, Matsudo, Japan

[73] Assignee: Komori Printing Machinery Co., Ltd., Tokyo, Japan

[21] Appl. No.: 58,686

[22] Filed: Jun. 4, 1987

Related U.S. Application Data

[63] Continuation of Ser. No. 883,023, Jul. 8, 1986, abandoned, which is a continuation of Ser. No. 728,051, Jun. 29, 1985, abandoned.

[30] Foreign Application Priority Data

Jul. 19, 1984 [JP] Japan ..... 59-148532

[51] Int. Cl.[5] ..... B41F 9/02; B41F 11/02

[52] U.S. Cl. ..... 101/152; 101/170; 101/DIG. 43

[58] Field of Search ..... 101/152, 154, 155, 156, 101/175, DIG. 22, DIG. 43, 170

[56] References Cited

U.S. PATENT DOCUMENTS

| | | | |
|---|---|---|---|
| 1,890,922 | 12/1932 | Waller | 101/152 |
| 3,390,631 | 7/1968 | Koszul | 101/155 |
| 3,583,316 | 6/1971 | Bolza-Schuenemann | 101/152 |
| 4,056,056 | 11/1977 | Giori | 101/152 |
| 4,516,496 | 5/1985 | Giori | 101/152 |

FOREIGN PATENT DOCUMENTS

| | | | |
|---|---|---|---|
| 173657 | 10/1983 | Japan | 101/152 |

*Primary Examiner*—Clifford D. Crowder

*Attorney, Agent, or Firm*—Townsend & Townsend

[57] ABSTRACT

An intaglio cylinder for effecting intaglio printing is disposed in contact with an impression cylinder and a blanket cylinder for effecting dry offset printing is disposed in contact with the intaglio cylinder. These cylinders are disposed such that a line interconnecting the axes of the impression cylinder and the intaglio cylinder will make an angle of about 90° with respect to a line interconnecting the axes of the intaglio cylinder and the blanket cylinder. When printing with the printing press described above a method is used comprising the steps of forming an intaglio image on the intaglio cylinder, forming a dry offset image on the blanket cylinder, transferring the dry offset image on the blanket cylinder onto non-image portions of the intaglio cylinder, and simultaneously transferring the dry offset image and the intaglio image on the intaglio cylinder onto a sheet wrapped about the impression cylinder.

2 Claims, 1 Drawing Sheet

METHOD AND APPARATUS FOR DRY OFFSET INTAGLIO PRINTING

This is a continuation of application Ser. No. 883,023, filed July 8, 1986, now abandoned, which was a continuation of Ser. No. 728,051, filed Apr. 29, 1985, now abandoned.

BACKGROUND OF THE INVENTION

This invention relates to a method and apparatus for dry offset intaglio printing in which a dry offset printing and an intaglio printing are effected continuously with a single machine.

In the dry offset printing, an image formed on the surface of a plate cylinder is transferred onto a blanket cylinder and then the image is transferred onto a paper sheet between the blanket cylinder and an impression cylinder, whereas in the intaglio printing an image formed on the intaglio plate on an intaglio cylinder is transferred onto a paper sheet between the intaglio cylinder and an impression cylinder.

Since impression cylinders of the same type and designed for the same purpose are used for both the dry offset printing and the intaglio printing, a combination type printing press capable of continuously effecting the dry offset printing and the intaglio printing with a single machine by utilizing a single impression cylinder for both types of printing has been developed. Such a machine is mainly used for printing such precise multicolor printed matter as bank notes and valuable securities.

FIG. 1 is a side view of a prior art dry offset intaglio printing press of the type described above. The printing press 1 shown in FIG. 1 comprises a sheet feed device 2, printing machine 3 and a delivery apparatus 4. The sheet feed device 2 includes a stack board 6 which supports stacked sheets 5 and is raised automatically, a sucker and a feed roller, not shown, which mounts sheets 5, one after one, onto a feed board 7. The printing machine 3 comprises an impression cylinder 8 wrapped with a blanket, not shown. The impression cylinder 8 is rotated in the direction of arrow A and a sheet 5 supplied from the feed board 7 through a swinging member 9 and paper transfer cylinders 10 and 11 is gripped by grippers (not shown) provided on the outer periphery of the impression cylinder 8 and wrapped thereabout. A blanket cylinder 12 having the same diameter as the impression cylinder 8, wrapped with a blanket, not shown, and rotated in the direction of arrow B is positioned on the right lower position of the impression cylinder 8. The periphery of the blanket cylinder 12 is maintained in contact with the impression cylinder. Four plate cylinders 13 respectively mounted with plates for dry offset printing and having a diameter of about ¼ that of the blanket cylinder 12 are provided on the righthand side of the blanket cylinder 12 in contact therewith. Ink supply device generally shown by a reference numeral 14 is provided to supply ink onto the plate surfaces of the plate cylinders 13. The ink supply device 14 is constituted by four ink fountain 15 storing inks of different colors, inking rollers, not shown, facing respective plate surfaces and groups of rollers, not shown, disposed between the ink fountains 15 and the inking rollers. On the lower left side (that is the side of the sheet delivery apparatus) of the impression cylinder 8 is disposed an intaglio cylinder 16. This cylinder is rotated in the direction of arrow C and has the same diameter as the impression cylinder 8. The intaglio cylinder 16 is mounted with four intaglio plates each having an intaglio image at an equal peripheral spacing. The intaglio cylinder 16 is also maintained in contact with the impression cylinder 8. On the side of the sheet delivery apparatus 4 are disposed three pattern rollers 17 each having a diameter of about ¼ of the intaglio cylinder 16. The pattern rollers 17 are also maintained in contact with the intaglio cylinder 16. An inking device 18 is provided for supplying ink to the intaglio plates of the intaglio cylinder 16 via the pattern rollers 17. Also the inking device 18 is constituted by three ink fountains 19 storing inks of different colors, and groups of rollers, not shown. A wiping device 20 is provided including a liquid tank 21 containing a detergent and a wiping roller 22 rotating in the detergent. The wiping device 20 is constructed to wipe off surplus ink adhered to the intaglio cylinder. The sheet delivery apparatus 4 is provided with a pair (left and right) of endless chains 26 each passing about a sprocket wheel 23 mounted on the shaft of a sheet receiving cylinder in contact with the impression cylinder 8 and about a sprocket wheel 25 at the front end of a frame 24 of the sheet delivery apparatus 4. A sheet stacking board 27 is provided beneath the front end of the endless chains 26.

In the printing press 1 described above, the sheets 5 sent onto the feed board 7 one after another from the stack board 6 are sequentially wrapped and transferred about the impression cylinder 8 via the swinging member 9 and the sheet transfer cylinders 10 and 11. Inks of different colors are supplied to the respective plate cylinders 13 from the ink fountains, and the images formed by the inks are transferred onto the blanket cylinder 12 as four dry offset images of four colors. Inks of three colors from the ink fountains 19 are also applied to recessed image forming portions and flat non-image portions of the intaglio plates mounted on the intaglio cylinders 16. The inks on the non-image portions are wiped off by the wiping roller 22 so that intaglio images of three colors whose inks are rubbed into the intaglio plates are left. In this manner, the four dry offset images formed on the blanket cylinder 12 are transferred onto the sheet 5 carried by the impression cylinder 8 and then the four intaglio images formed on the intaglio cylinder 16 are transferred onto the sheet 5. The sheet 5 thus printed is conveyed by the sheet delivery chains 26 to be stacked on the stack board 27.

Since the dry offset intaglio printing press having a construction described above is used to print such printed matter as paper monies and valuable securities for the purpose of preventing counterfeit, a highly precise registering accuracy is desired. Especially, a high registering accuracy between the dry offset printing and the intaglio printing is desired. To obtain an extremely high registering accuracy in the prior art, the difference in the printing pressure between the intaglio printing and the dry offset printing presented a problem. More particularly, in the intaglio printing an extremely large printing pressure has been desired for the purpose of transferring inks rubbed into the recesses of the intaglio plate onto the sheet, whereas in the dry offset printing a relatively small printing pressure is sufficient. Thus, when these two types of printing are made with a common impression cylinder 8, the large printing pressure applied during the intaglio printing causes deflection of the shaft of the impression cylinder 8 as well as bearing clearance with the result that the displacement of the axis of the impression cylinder 8 causes a phase difference between the impression cylinder 8 and the blanket cylinder 12, thereby greatly impairing the registering accuracy of the dry offset printing. When the intaglio printing is made under a high printing pressure between the impression cylinder 8 and the intaglio cylinder 16 immediately after the dry offset printing in which the printing pressure between the impression cylinder 8 and the blanket cylinder 12 is small, so that the dimension of the sheet does not vary appreciably, the dimension of the sheet 5 would vary substantially, thus resulting in non-registration of the dry offset printing and the intaglio printing.

For this reason, as shown in FIG. 1, the angle between a line interconnecting the axes of the impression cylinder 8 and the blanket cylinder 12 and a line interconnecting the axes of the impression cylinder 8 and the intaglio cylinder 16 is made to be 90° so as to prevent the displacement of the axis of the impression cylinder caused by a large printing pressure at the time of the intaglio printing from causing the variation in the dry offset printing pressure. Even with this measure, the displacement of the axis of the impression cylinder 8 caused by the printing pressure at the time of the intaglio printing acts in the direction of rotation of the blanket cylinder 12 so that a satisfactory result can not always be expected. As a countermeasure for the variation of the sheet size, a method has been tried in which the dimension variation of the sheet caused by the pressure at the time of the intaglio printing is converted into data representing the real value of the elongation based on the actual printing result and in which, at the time of manufacturing the plates, an elongation percentage on the basis of the above described data is used as a correction value between the intaglio plate and the dry offset plate. But the data thus obtained differs from the actual printing result in many cases, thus failing to obtain satisfactory results.

SUMMARY OF THE INVENTION

It is a principal object of this invention to provide an improved method and apparatus for dry offset intaglio printing capable of minimizing the effect of the displacement of the axis of the impression cylinder caused by as large printing pressure applied at the time of the intaglio printing upon the blanket cylinder thereby improving the registering accuracy between the intaglio printing and the dry offset printing.

Another object of this invention is to provide a dry offset intaglio printing press capable of simultaneously performing the dry offset printing and the intaglio printing without the necessity of considering the dimension variation of the sheet between the dry offset printing and the intaglio printing.

According to one aspect of this invention there is provided a dry offset intaglio printing press comprising an impression cylinder, an intaglio cylinder having an intaglio plate mounted thereon such that a sheet to be printed will be conveyed between the intaglio plate and the impression cylinder, and a blanket cylinder disposed in contact with the intaglio cylinder such that a line interconnecting the axes of the blanket cylinder and the intaglio cylinder makes an angle of about 90° with respect to a line interconnecting the axes of the impression cylinder and the intaglio cylinder.

According to another aspect of this invention, there is provided a method of offset intaglio printing utilizing an intaglio cylinder, an impression cylinder and a blanket cylinder, the method comprising the steps of forming a dry offset image on the blanket cylinder, forming an intaglio image on the intaglio cylinder, transferring the dry offset image formed on the blanket cylinder onto a non-image portion of the intaglio cylinder by rotating the same in contact with the blanket cylinder, and simultaneously transferring onto a sheet wrapped about the impression cylinder the intaglio image and the dry offset image on the intaglio cylinder.

With this method and apparatus, the registering accuracy of the intaglio printing and the dry offset accuracy can be improved and these two types of printing can be effected at the same time at the same position.

DESCRIPTION OF THE PREFERRED EMBODIMENT

Figure 1:
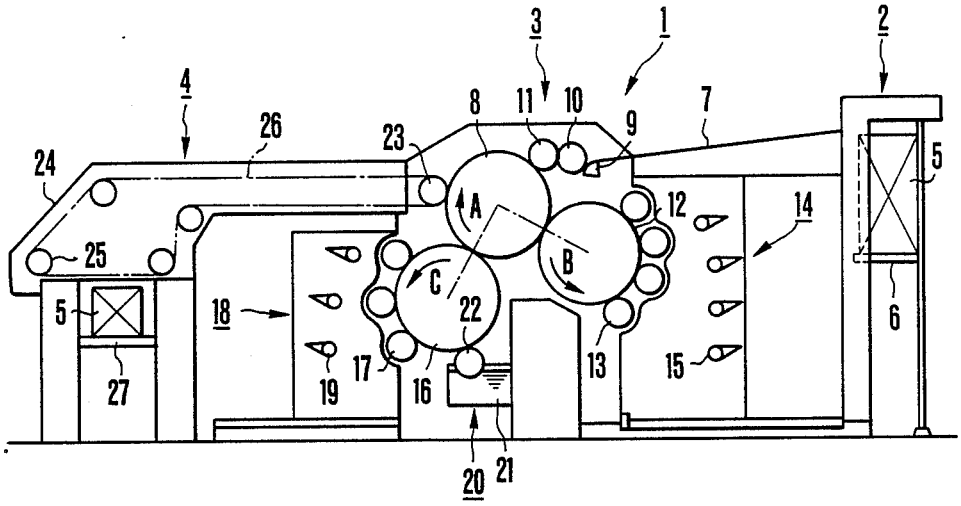
FIG. 1 is a diagrammatic side view showing a prior art dry offset intaglio printing press.
Figure 2:
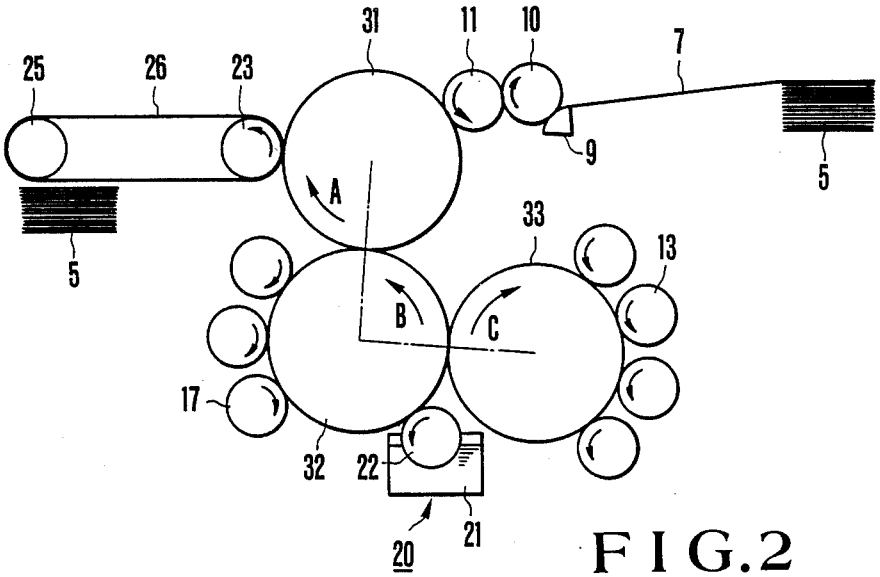
FIG. 2 is a diagrammatic side view showing essential parts of one embodiment of the dry offset intaglio printing press according to this invention.

A preferred embodiment of the dry offset intaglio printing press will now be described with reference to FIG. 2 in which the sheet feed device, the sheet delivery apparatus and the inking device are identical to those of the prior art printing press shown in FIG. 1, so that they are not shown and described. As shown in FIG. 2, the peripheral surface of an impression cylinder 31 covered with a blanket, not shown, and rotating in the direction of arrow A, of a sheet transfer cylinder 11 and a sheet strip off cylinder coaxial with sprocket 23, not shown, are in contact with each other. The sheet 5 conveyed to the impression cylinder 31 via swinging member 9 and sheet transfer cylinders 10 and 11 is gripped by the grippers of the impression cylinder 31 to be wrapped about the lower half thereof and then delivered by being gripped by the grippers of the sheet delivery endless chains 26. Just beneath the impression cylinder 31 is positioned an intaglio cylinder 32 having substantially the same diameter as the impression cylinder 31 in direct contact therewith. Three pattern rollers 17 each having a diameter of about $\frac{1}{4}$ of that of the intaglio cylinder 32 are disposed in contact therewith. The intaglio cylinder 32 is rotated in the direction of arrow B, and four intaglio plates containing recessed image forming portions and flat non-image portions are mounted on the periphery of the intaglio cylinder 32. The periphery of each pattern roller 17 is formed with an image corresponding to the image forming portions of the intaglio plate and inks of different colors are applied to an area slightly larger than the image. A very large printing pressure is applied between the impression cylinder 31 and the intaglio cylinder 32. A wiping device 20 having a wiping roller 22 in contact with the intaglio plates of the intaglio cylinder 32 is provided for washing away surplus ink applied to the non-image portions of the intaglio plates by the pattern rollers 17 by means of a detergent contained in a tank 21. On the sheet feed side of the intaglio cylinder 32 is positioned a blanket cylinder 33 covered with a blanket, not shown, and rotating in the direction C in contact with the intaglio cylinder 32, the blanket cylinder 33 having the same diameter as the intaglio cylinder 32. A slight printing pressure is applied between the intaglio cylinder 32 and the blanket cylinder 33. The cylinders 31, 32 and 33 are disposed such that an angle between a line interconnecting the axes of the intaglio cylinder 32 and the blanket cylinder 33 and a line interconnecting the axes of the intaglio cylinder 32 and the impression cylinder 31 becomes substantially 90° . Four plate cylinders 13 each having a diameter of about ¼ of that of the blanket cylinder 33 are disposed to the right thereof. Each plate cylinder 13 is mounted with a dry offset plate in contact with the periphery of the blanket cylinder 33. In this embodiment, the dry offset plate comprises a relief of 0.7 mm thickness in which an image forming portion of a thickness of 0.4 mm projects from a non-image portion of a thickness of 0.3 mm. Inks of four colors are applied onto the image forming portions of the respective dry offset plates and the inks thus applied are transferred onto the blanket cylinder 33.

The printing operation of the printing press of this embodiment will be described as follows by taking paper money as an example. A sheet 5 sent out onto the feed board 7 is wrapped about the lower half of the impression cylinder 31 after passing through the swinging member 9 and the sheet transfer cylinders 10 and 11. At this time, inks are applied onto the projected dry offset plate surfaces of the respective plate cylinders 13 from the inking device 14 so as to print the ground images of the paper money with different colors, and these images are transferred onto the peripheral surface of the blanket cylinder 33 by the rotation thereof. Inks are rubbed into the image recesses of the intaglio plates on the intaglio cylinder 32 by the pattern rollers, and inks are also applied onto a portion of the non-image portions surrounding the image forming recesses. The inks applied onto the non-image portions are wiped off by the wiping device 20 so that when the intaglio cylinder 32 comes into contact with the blanket cylinder 33, inks will have been rubbed into only the image forming recesses of the intaglio cylinder 32 to form such images as portraits and patterns of the paper monies. Accordingly, when the peripheries of the intaglio cylinder 32 and the blanket cylinder 33 are brought into contact, the images such as ground patterns and the like are transferred onto the periphery of the intaglio cylinder 32 to register with the images including the portraits and patterns of the intaglio plate. The registered images are transferred under a high printing pressure onto a sheet 5 conveyed between the impression cylinder 31 and the intaglio cylinder 32 thereby simultaneously printing the images of the intaglio plate and the dry offset plate on the sheet 5. The sheets 5 thus printed are conveyed by the delivery endless chains 26 and stacked on the stack board 27 shown in FIG. 1.

In the dry offset intaglio printing press of this invention, since the dry offset printing and the intaglio printing are made simultaneously under a large printing pressure at a point at which the impression cylinder 31 and the intaglio cylinder 32 contact with each other, the registration accuracy of the two printings can be improved. This has been impossible in the prior art printing press in which the dry offset printing and the intaglio printing are made at different points. This not only greatly improves the quality of the printed matter but also eliminates troublesome corrections at the stage of preparing the plates, thus rationalizing the steps.

The large printing pressure between the impression cylinder 31 and the intaglio cylinder 32 acts in the direction of the self weight of the intaglio cylinder 32 so that displacement of the axis of the intaglio cylinder 32 caused by the bearing clearance thereof can be avoided, thus minimizing the adverse effect upon the blanket cylinder 33. Moreover, the dry offset image, which is transferred from the blanket cylinder 33 onto the intaglio plate, remains partially on the intaglio plate even after its transfer onto the sheet 5, but this remaining dry offset image is wiped off the intaglio plate by means of the wiping device 20 prior to the transfer of a fresh dry offset image onto the intaglio plate, thereby preventing the fresh dry offset image from being laid on the remaining one.

It will be clear that, the blanket cylinder 33 can be disposed on the lefthand side of the intaglio cylinder 32 as viewed in FIG. 2.

What is claimed is:

1. A method of offset intaglio printing utilizing an intaglio cylinder, an impression cylinder and a blanket cylinder, the method comprising the steps of:

forming a dry offset image on said blanket cylinder;

forming an intaglio image on said intaglio cylinder;

transferring said dry offset image formed on said blanket cylinder onto a non-image portion of said intaglio cylinder by rotating the same in contact with said blanket cylinder while maintaining the axis of said intaglio cylinder in precise registration relative to the axis of said blanket cylinder so that non-registration of the dry offset image and the intaglio image, due to a potential displacement of the axis of the intaglio cylinder relative to the axis of the blanket cylinder in accordance with substantial pressure applied thereon by the impression cylinder, does not occur; and simultaneously transferring onto a sheet wrapped about said impression cylinder said intaglio image and said dry offset image on said intaglio cylinder, in accordance with said pressure.

2. In a dry offset intaglio printing press for printing on a sheet a part of an image to be printed by intaglio printing and a remaining part of the image to be printed by dry offset printing, said press having an intaglio cylinder provided with at least one intaglio plate mounted on a peripheral surface thereof and mounted for rotation about the axis thereof in a predetermined direction, said intaglio plate having on a surface thereof a recessed portion corresponding to said part of the image to be printed and a flat portion corresponding to said remaining part of the image, first inking means disposed at a first peripheral portion of said intaglio cylinder for entirely filling the recessed portion of said intaglio plate with an ink; wiping means disposed at a second peripheral position of said intaglio cylinder for cleaning up said flat portion of said intaglio plate after the recessed portion is filled with the intaglio ink by said first inking means; a blanket cylinder provided on a peripheral surface thereof with a blanket on which is formed an inked dry offset image corresponding to said remaining part of the image to be printed; means for forming the inked dry offset image on said blanket and an impression cylinder disposed in contact with said intaglio cylinder and rotated in a direction opposite to that of said intaglio cylinder for impressing the image formed on said intaglio plate onto a sheet which is fed to a contact line of said impression and intaglio cylinders, a sufficiently large pressure for impressing the image to be printed on the sheet being applied at the contact line of said intaglio and impression cylinders in a direction extending from the axis of said impression cylinder toward the axis of said intaglio cylinder;

the improvement wherein said blanket cylinder is disposed in contact with said intaglio cylinder and is mounted for rotation in an opposite direction to that of said intaglio cylinder while pressure is applied thereto in a direction extending from the axis thereof to the axis of said intaglio cylinder, the relative positioning of said blanket cylinder and said intaglio cylinder being selected such that the dry offset image on said blanket cylinder is registered to the intaglio image on said intaglio cylinder at a contact line of said intaglio and blanket cylinders when rotated whereby the inked dry offset image is transferred to the flat portion of said intaglio plate to form the entire image to be printed on the intaglio plate; and wherein said intaglio and said blanket cylinders are relatively positioned such that a common tangential plane of said intaglio and blanket cylinders is substantially vertical, and wherein said intaglio and said impression cylinders are relatively positioned such that a plane containing the axes of said impression and intaglio cylinders is substantially parallel with said common tangential plane, whereby the direction of the impressing pressure coincides with the direction of the force due to the empty weight of said intaglio cylinder so that the axis of said intaglio cylinder is stabilized and the contact line of said intaglio and blanket cylinders is not moved along the common tangential plane in response to the said impressing pressure.

* * * * *